United States Patent [19]

Connors

[11] 3,965,543

[45]*June 29, 1976

[54] SHE-BOLT TYPE GRIPPER DEVICE FOR CONCRETE WALL FORM TIE RODS OF INDETERMINATE LENGTH

[75] Inventor: Frank T. Connors, Deerfield, Ill.

[73] Assignee: Symons Corporation, Des Plaines, Ill.

[ * ] Notice: The portion of the term of this patent subsequent to Oct. 7, 1992, has been disclaimed.

[22] Filed: Jan. 27, 1975

[21] Appl. No.: 544,179

Related U.S. Application Data

[63] Continuation-in-part of Ser. No. 526,076, Nov. 22, 1974, Pat. No. 3,910,546.

[52] U.S. Cl. ..... 24/136 R; 52/223 L; 249/40; 249/219 R; 254/29 A; 425/111

[51] Int. Cl.[2] ..... E04G 17/08; F16G 11/04

[58] Field of Search ..... 425/111; 249/219 R, 249/190, 191, 188, 216, 213, 214; 24/136 R, 155 BR, 263 C, 263 CA, 263 SC; 52/223 L

[56] References Cited

UNITED STATES PATENTS

| | | | |
|---|---|---|---|
| 3,163,904 | 1/1965 | Ziolkowski | 425/111 |
| 3,703,748 | 11/1972 | Kelly | 52/223 L |
| 3,762,027 | 10/1973 | Burtelson | 52/223 L |
| 3,852,850 | 12/1974 | Filhaber | 24/136 R |

*Primary Examiner*—Francis S. Husar
*Assistant Examiner*—John S. Brown
*Attorney, Agent, or Firm*—Norman H. Gerlach

[57] ABSTRACT

A releasable, reusable, slip-on, she-bolt type gripper device designed for telescopic reception therein or therethrough of one of the projecting end regions of a cylindrical horizontally extending tie rod as used in connection with a concrete wall form or the like and adapted to receive the reaction pull of the tie rod incident to the pouring of wet concrete between the wall form sides. The device embodies a series of circumferentially arranged chuck-forming jaws which normally grip the adjacent tie rod end region but which become released therefrom when a hollow pull rod through which said tie rod end region extends is actuated. Because the pull rod is hollow and the adjacent end region of the tie rod may project completely through such pull rod, as well as through the entire gripper device, the tie rod with which the device is associated need not be cut to length and any excess protruding portion of such tie rod as may project from the finished concrete wall after the gripper device has been removed from the adjacent projecting end region of the tie rod and after the concrete wall form has been dismantled or taken down, may be wrested or otherwise removed from the wall.

4 Claims, 2 Drawing Figures

Figure 1:
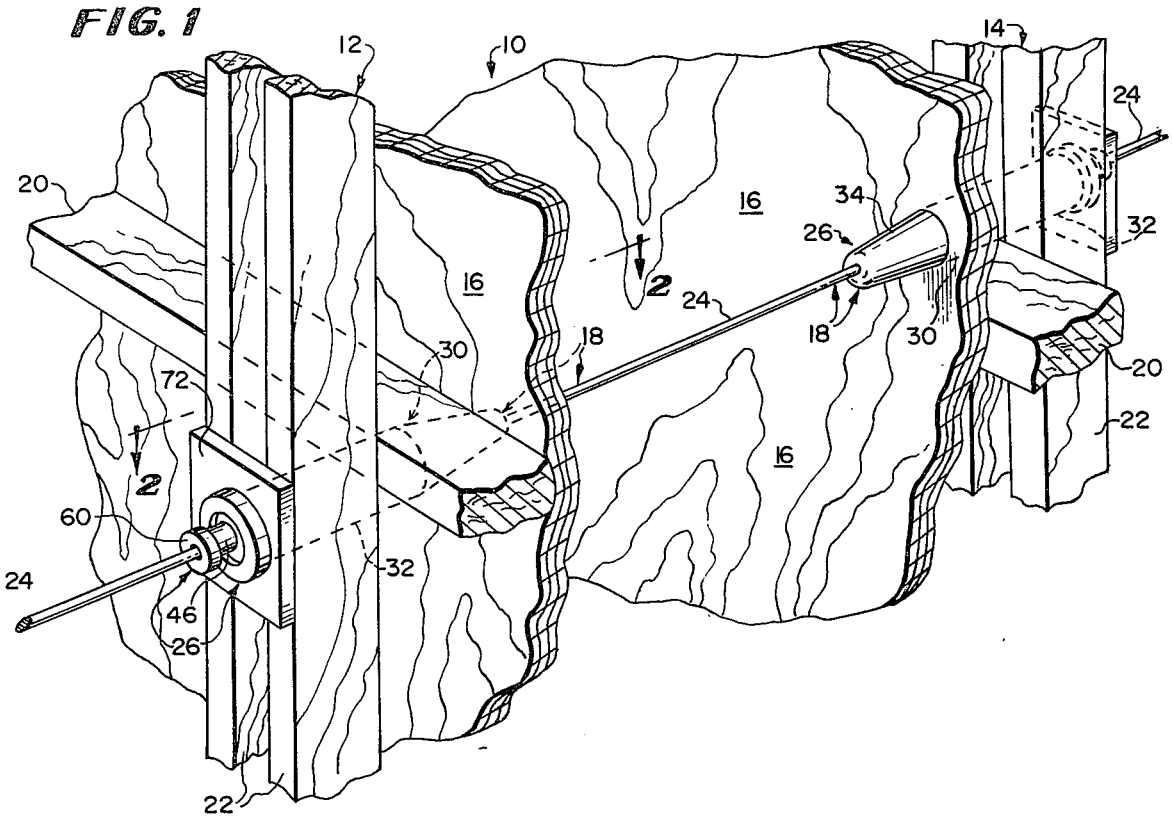

SHE-BOLT TYPE GRIPPER DEVICE FOR CONCRETE WALL FORM TIE RODS OF INDETERMINATE LENGTH

CROSS REFERENCE TO RELATED APPLICATION

This application is a continuation-in-part of U.S. Pat. application Ser. No. 526,076, filed on Nov. 22, 1974, and entitled "SHE-BOLT TYPE GRIPPER DEVICE FOR CONCRETE WALL FORM TIE RODS OF INDETERMINATE LENGTH" (now U.S. Pat. No. 3,910,546, dated Oct. 7, 1975)..

The present invention relates to a releasable, reusable gripper device which is designed primarily for use as a slip-on she-bolt in connection with a conventional concrete wall form or other form where it is telescopically received over one end of a horizontally extending tie rod during concrete-pouring operations. The invention is particularly concerned with a gripper device of the general type which is shown and described in my above-identified copending U.S. Pat. application Ser. No. 526,076.

As is the case with the gripper device which is disclosed in the aforementioned patent application Ser. No. 526,076, the gripper device constituting the present invention is capable of uses other than in connection with concrete wall forms and, if desired, the same may, either with or without modification as required, be employed as a dead-end or medial anchor member for a wide variety of tensioned rod-like members, wires or the like, or as a pulling device by means of which tension may be applied to a rod or wire. Irrespective, however, of the particular use to which the present gripper device may be put, the essential features thereof are at all times preserved.

The general aims and objects of the present invention are substantially the same as those of my aforementioned copending patent application Ser. No. 526,076, but the particular gripper device of the present application is regarded as an improvement over that of my earlier device and, therefore, in the interests of brevity, the feature which is regarded as the improvement will be discussed herein in detail, while the entire disclosure of such copending application, insofar as it is consistent with the present disclosure, is by reference thereto hereby incorporated in the present application.

Briefly, the gripper device of my copending patent application Ser. No. 526,076 embodies a generally cylindrical shell having internal annular series of chuck-forming segments which are disposed in said shell end portion and are spring-biased forwardly in the shell so that such segments, by reason of their camming engagement with the tapered wall of the shell, are forced radially inwardly toward one another and into gripping relationship with respect to the adjacent end of a tie rod which is projected into the forward end of the shell. A longitudinally extending solid pull rod which is coaxial with the shell projects rearwardly or outwardly thereof and, therefore, is also coaxial with the tie rod which is gripped. The pull rod is connected in common to the chuck-forming segments and extends rearwardly of the shell so that when it is desired to release the gripper device from the tie rod and dismantle the associated concrete wall form, it is merely necessary to pry or otherwise pull the pull rod rearwardly, whereupon the chuck segments will be released and the entire device may be slid bodily as a unit from the tie rod for reuse in a subsequent concrete wall form installation. The device is thus necessarily a dead-end gripper device since the adjacent end region of the tie rod does not pass completely through the device and, therefore, its use is limited to association with tie rods which are of the cut-to-length variety and have breakbacks at appropriate points therealong whereby it is possible readily to wrest the projecting tie rod end regions from the hardened concrete wall.

The improvement which is comprehended by the present invention resides in the fact that the aforementioned pull rod is of hollow or tubular construction to the end that the associated tie rod which is undergoing gripping by the device may pass completely through such pull rod and project rearwardly or outwardly of the gripper device. Thus, it is not necessary to use tie rods which are cut to length and tie rods of indeterminate length may be used with the device, the only requisite being that the tie rods be long enough completely to span the associated concrete wall form and project outwardly on opposite sides of the form a sufficient distance that either projecting end region may be gripped by the chuck-forming segments within the tubular shell of the gripper device. Any excess projection of the adjacent end region of the associated tie rod, however great, is immaterial inasmuch as such end region may pass either into or completely through the pull rod. After the pull rod has been manipulated to release the jaw segments from the tie rod, the entire gripper device may be slid longitudinally until it moves off the adjacent end region of the tie rod, after which the portion of the tie rod which projects outwardly from the hardened concrete of the wall may be wrested or otherwise severed from the wall.

The provision of an improved gripper device such as has briefly been outlined above constitutes the principal object of the present invention.

Other objects and advantages of the invention, not at this time set forth, will become readily apparent as the nature of the invention is better understood from a consideration of the following detailed description.

The invention consists in the several novel features which are hereinafter described and are more particularly defined by the claims at the conclusion hereof.

In the accompanying single sheet of drawings forming a part of this specification, one embodiment of the invention is illustrated.

Figure 2:
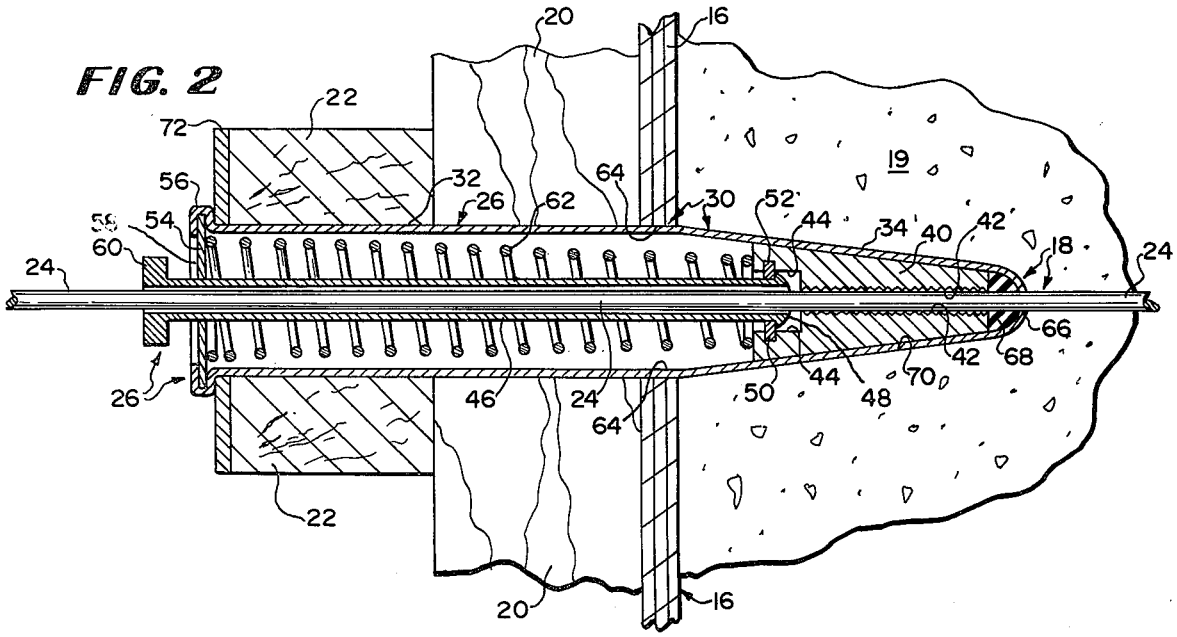

In these drawings:

FIG. 1 is a fragmentary perspective view, partly in section, of a concrete wall form showing two of the improved gripper devices in use as she-bolts; and FIG. 2 is an enlarged longitudinal sectional view taken on the horizontal plane indicated by the line 2—2 of FIG. 1 and in the direction of the arrows.

Referring now to the drawings in detail and in particular to FIG. 1, a fragmentary portion of a concrete wall form of conventional construction is illustrated therein and it is designated in its entirety by the reference numeral 10. The wall form 10 is made up of two upstanding, spaced apart series 12 and 14 of rectangular plywood panels 16, the panels of each series being arranged in edge-to-edge relationship and forming one side of the concrete wall form 10. The panels 16 of the two series are designed to have wet concrete poured in the space between them for the purpose of forming an upstanding wall 19 upon hardening of the concrete, are maintained in spaced parallel relationship by means of combined spreader and tie rod assemblies 18. Only one such assembly is disclosed in FIG. 1 and it is illustrated as extending horizontally across the form 10 and through and beyond two opposed panels 16. The concrete wall 19 is omitted in FIG. 1 in the interests of clarity. The form 10 which is illustrated in FIG. 1 in order to establish the usual environment of the gripper device of the present invention is of the all-wood variety and the plywood panels of each of the two series 12 and 14 are backed by horizontal waler boards 20 and vertical strongbacks 22 in a manner well known in the art.

Referring now to both views of the drawings, the illustrated combined spreader and tie rod assembly 18 is comprised of a horizontally extending tie rod 24 of circular cross section and a pair of gripper devices which are designated in their entirety by the reference numeral 26, such devices functioning in the manner of she-bolts for assimilating the tension in the tie rod 24 at such time as wet concrete is poured between the two sides of the concrete wall form 10.

Each gripper device 26 embodies an elongated metal shell 30 having a cylindrical rear or outer section 32 and a frusto-conical front or inner section 34, the shell being of open-ended design. Disposed within the front frusto-conical section 34 of the shell 30 is a chuck-forming series of four circumferentially arranged jaw segments 40, each of which is of elongated tapered design and is formed with a curved outer surface which is adapted to slide longitudinally on the inner surface of the forward frusto-conical section 34 of the shell 30. The inner surface of each jaw segment 40 is provided with a longitudinally extending series of tie rod gripping teeth 42 which extend along a major portion of the segment. The rear end of each jaw segment 40 is formed with a recess 44 (see FIG. 2), the four recesses when considered collectively establishing a pocket-like void which receives therein the forward end of an elongated tubular pull rod 46 which will hereinafter be referred to as a pull tube. The pull tube 46 is coaxial with and encompasses the adjacent end region of the tie rod 24 and the forward end of the tube is provided with a rivet-like enlargement 48. Immediately rearwardly of such enlargement is a pull washer or flange 50 which projects into a series of inwardly facing notches 52 in the rear ends of the jaw segments 40, there being one such slot in the recessed portion 44 of each jaw segment.

A circular rear wall 54 extends across the otherwise normally open rear rim of the shell 30, the rim being beaded over such wall as indicated at 56 in order fixedly to secure said rear wall in place. Said rear wall 54 has formed therein a central hole or opening 58 through which the pull tube 46 slidingly projects. The rear end of the pull tube 46 is provided with a radially and outwardly extending annular pull flange 60 which normally occupies a position a slight distance rearwardly of the rear wall 54, such flange constituting a pry-head by means of which the pull tube may be forced bodily rearwardly, utilizing a suitable pry tool such as a claw hammer or the like. A helical compression spring 62 is disposed in the shell 30 and extends around the pull tube 46. It bears at its rear end against the rear wall 54 of the shell of the gripper device and at its forward end against the four jaw segments 40. Thus, such spring normally urges the jaw segments forwardly within the shell 30 and causes them, by reason of their camming action against the slanting inner face of the shell section 34, to contract centripetally and grip the tie rod 24 therebetween.

The front end portion of the shell 30 projects through an opening or hole 64 in the associated plywood panel 16 and becomes embedded within the concrete of the wall 19 at such time as the concrete is poured between the two form sides which are formed by the two panel series 12 and 14. It is, therefore, necessary to seal the front end section 34 of the shell 30 against the entrance of wet concrete at the time of concrete pouring. Accordingly, the front section 34 of the shell 30 has its forward end cupped inwardly as indicated at 66 so as thus, in effect, to define a front wall for the shell. Seated within such cupped portion 66 is an elastomeric sealing ring 68 through which extends the tie rod 24 of the combined spreader and the rod assembly 18.

It is to be noted at this point that the slant angle of the frusto-conical front section 34 of the shell 30 is relatively small so that a considerable degree of rearward movement of the pull rod 46 may take place without causing the pull washer or flange 50 to become dislodged from the slots 52 at the time the jaw segments 40 are shifted rearwardly for purposes of tie rod release. Therefore, the maximum extent of prying action of which a tool such as a claw hammer may exert against the pull flange or head 60 is not so great as to present any danger of such dislodgment.

In the initial installation of the gripper devices 26 with respect to the concrete wall form 10, after the panels 16 have been set up, the tie rod 24 of the assembly 18 is inserted or threaded longitudinally or endwise through the two aligned holes 64 in the opposed plywood panels 16 and thereafter the gripper devices 26 are threaded onto the opposite projecting ends of the tie rod by causing such ends to be inserted endwise through the cupped forward portions 66 of the gripper shells 30, and from thence through the sealing rings 68, past the jaw segments 40 which will automatically become spread apart under the endwise pressure of the tie rod ends, and from thence through the hollow tubular pull tubes 46. If the tie rod 24 is of appreciable length, the end portions thereof will pass completely through the gripper devices 26 as shown in the drawings and these devices may then be slid inwardly toward the form sides until the frusto-conical sections 34 of the shells 30 pass through the holes or openings 64 in the plywood panels 16 as clearly shown in FIG. 1. At this time, the helical compression spring 62 of each gripper device 26 will force the associated jaw segments 40 to close firmly upon the tie rod 24 so that the gripper devices as a whole will assimilate the outward thrust which is exerted upon the form sides at the time the wet concrete is poured into the space or void within the form. With the tie rod 24 thus securely gripped by the jaw segments 40 of each gripper device 26, the gripper devices then function in the manner of she-bolts and constitute elements of concrete form hardware in the concrete wall form as a whole.

In order to dismantle the concrete wall form 10 after the concrete of the wall 19 has become set, it is merely necessary to exert an outward prying action on the pry head of flange 60 of each pull tube 46 in the manner previously described. A slight amount of such prying action will pull the pull tube rearwardly a sufficient distance to cause the associated jaw segments 40 to release the tie rod 24, after which the entire gripper device 26 may be slid outwardly away from the form until such time as it slides off the adjacent end extremity of the tie rod. Such withdrawal of the gripper devices 26 from the concrete of the wall 19 will, of course, leave frusto-conical socket-like indentations or depressions 70 in the side surfaces of the wall and the projecting end portions or regions of the tie rod 24 will remain projecting coaxially with such depressions and outwards of the wall. After the sides of the concrete wall form 10, including the panels 16, the waler boards 20 and the strongbacks 22, have been dismantled from the wall 19, the wall 19 may be finished by bending the projecting end portions of the tie rod downwardly at a small angle, and thereafter severing them from the concrete-embedded intermediate portion of the tie rod 24 by the use of a chisel or the like, the severing taking place at some points within the depressions 70. Alternatively the projecting end portions of the tie rod may be twisted, utilizing a conventional tie rod extracting tool which functions in the manner of a Stillson wrench. The depressions 70 may then be patched in the usual manner with grout, thus embedding the protruding remnant of the tie rod 24 within the grout. At the time of initial application of the gripper devices 26 to the concrete wall form 10, it may be found expedient telescopically to insert rectangular centrally-apertured seating plates 72 over the shells 30 and against the beaded rim portions 56 of the shells, the seating plates constituting reaction members which bear against the vertical strongbacks 22 and assimilates the inward pull of the gripper devices when the tie rod 24 is under tension.

The invention is not to be limited to the exact arrangement of parts shown in the accompanying drawings or described in this specification as various changes in the details of construction may be resorted to without departing from the spirit or scope of the invention. For example, the particular gripper device 26 is not limited to use in connection with tie rods which are intended to remain embedded within the concrete of the wall 19, and under certain circumstances, when lubricant type or other coatings are applied to the tie rod, instead of wresting the protruding end portions of the tie rod from the wall 19, the entire rod may be pulled longitudinally with sufficient force that it will be withdrawn from the wall, thus leaving a transverse bore extending from one side of the wall to the other. The end regions of such a transverse bore may then readily be patched with grout. Furthermore, the present gripper device is capable of use in connection with concrete wall forms of the "Steel-Ply" type such as are manufactured and sold by Symons Corporation of Des Plaines, Ill. In such an instance, the entire gripper device will remain exteriorly of the adjacent side of the associated concrete wall form and will not project into the poured concrete of the wall. Either the forward end of the gripper device may be allowed to contact such side of the form or a suitable seating cup of appropriate contour may be utilized in place of the seating plate 72. Therefore, only insofar as the invention is particularly pointed out in the accompanying claims is the same to be limited.

Having thus described the invention, what I claim as new and desire to secure by Letters Patent is:

1. As a new article of manufacture, a gripper device designed for use as a she-bolt in gripping the outer end region of a tie rod in associated relation with a concrete wall form, said device comprising a tubular shell having a frusto-conical front section and a cylindrical rear section, tooth-equipped jaw segments slidable in said front section and defining a chuck structure for reception therethrough of the tie rod, a circular wall extending across the rear end of the shell, a compression spring interposed between said wall and jaw segments and effective to bias the latter forwardly into tie rod-gripping relationship, an elongated cylindrical pull tube through which the tie rod is adapted to extend to any desired extent including through the open rear end of the tube, said pull tube projecting centrally and slidably through said circular wall coaxially with the shell and being capable of sliding movement longitudinally on the tie rod, said pull tube having its forward end operatively connected in common to the rear ends of the chuck segments and effective when pulled rearwardly to release such segments from the tie rod, and a radial flange carried on the rear end of said hollow pull tube exteriorly of the shell and disposed in close proximity to said circular wall, said flange, in combination with said circular wall, constituting a pry-head by means of which the pull tube may be pried rearwardly with respect to the shell.

2. A gripper device as set forth in claim 1 and wherein the forward end of said pull tube carries a radial pull flange which projects radially into and interlocks with a series of slots in the rear ends of said jaw segments.

3. A gripper device as set forth in claim 2 and wherein the forward end of said shell is cupped inwardly to provide for the shell a front annular wall through which the tie rod is adapted to project.

4. A gripper device as set forth in claim 3 and wherein there is disposed within the forward cupped end of the shell immediately forwardly of the jaw segments a sealing ring through which the tie rod is adapted to project.

* * * * *